United States Patent [19]

Kozima et al.

[11] 4,348,470

[45] Sep. 7, 1982

[54] ELECTROPHOTOGRAPHIC ELEMENT CONTAINING DISAZO COMPOUNDS

[75] Inventors: Akio Kozima, Hiratsuka; Eiichi Akutsu, Ichikawa; Kiyomi Ichizuka, Tokyo, all of Japan

[73] Assignee: Ricoh Co., Ltd., Tokyo, Japan

[21] Appl. No.: 100,066

[22] Filed: Dec. 4, 1979

[30] Foreign Application Priority Data

Dec. 13, 1978 [JP] Japan ..... 53-154474

[51] Int. Cl.[3] ..... G03G 5/06; G03G 13/22

[52] U.S. Cl. ..... 430/72; 430/58; 430/76; 430/78; 260/176

[58] Field of Search ..... 430/79, 72, 58, 70, 430/96; 260/174, 190

[56] References Cited

U.S. PATENT DOCUMENTS

| | | | |
|---|---|---|---|
| 3,775,105 | 11/1973 | Kukla | 430/80 |
| 3,837,851 | 9/1974 | Shattuck et al. | 430/59 |
| 3,871,882 | 3/1975 | Wiedemann | 430/59 |
| 3,977,870 | 8/1976 | Rochlitz | 430/59 |
| 4,018,607 | 4/1977 | Contois | 430/73 |
| 4,026,704 | 5/1977 | Rochlitz | 430/57 |
| 4,052,210 | 10/1977 | Hectors | 430/72 |

FOREIGN PATENT DOCUMENTS

| | | | |
|---|---|---|---|
| 48-17354 | 5/1973 | Japan | 430/96 |

*Primary Examiner*—John E. Kittle
*Assistant Examiner*—John L. Goodrow
*Attorney, Agent, or Firm*—Blanchard, Flynn, Thiel, Boutell & Tanis

[57] ABSTRACT

The present invention provides an electrophotographic element which comprises a charge generating layer and a charge transport layer formed, in order, on an electroconductive substrate, said charge generating layer comprising a disazo pigment expressed by the general formula:

[wherein A represents represents a member selected from the group consisting of benzene ring, naphthalene ring, indole ring, carbazole ring, benzofuran ring and their substitutes; $Ar_1$ represents a member selected from the group consisting of benzene ring, naphthalene ring, dibenzofuran ring, carbazole ring and their substitutes; each of $Ar_2$ and $Ar_3$ represents a member selected from the group consisting of benzene ring, naphthalene ring and their substitutes; each of $R_1$ and $R_3$ represents a member selected from the group consisting of hydrogen, lower alkyl radical, phenyl radical and their substitutes; and $R_2$ represents a member selected from the group consisting of lower alkyl radical, carboxyl radical and alkyl ester thereof)] and a mixture of binder materials comprising polyvinyl butyral and acrylic resin.

5 Claims, No Drawings

ELECTROPHOTOGRAPHIC ELEMENT CONTAINING DISAZO COMPOUNDS

BACKGROUND OF THE INVENTION (a) Field of the Invention

The present invention relates to an electrophotographic element having a charge generating layer and a charge transport layer formed on an electroconductive substrate, coupled with a process for manufacturing said element, and more particularly it relates to an improvement on the charge generating substances and binders for use in the charge generating layer.

(b) Description of the Prior Art

There have hitherto been proposed a variety of layered electrophotographic elements consisting of an electroconductive substrate, the so-called charge generating layer capable of generating a charge carrier through light absorption which is formed on said substrate and the so-called charge transport layer capable of transferring the thus generated charge carrier by force of an electric field which is superposed on said charge generating layer. In order to improve the electrophotographic characteristics of these layered electrophotographic elements, especially the sensitivity and light fatigue thereof, it is necessary that said charge generating layer be uniform, extremely thin and smooth. Accordingly, application of such processes as (1) depositing a charge generating substance such as Se, Se alloy, organic pigment, etc. through vacuum evaporation (as proposed in, for instance, Japanese Laid-Open Patent Application No. 47838/1973; U.S. Pat. No. 3,973,959), (2) coating a dispersion prepared by dispersing a charge generating substance such as Se, Se alloy, inorganic pigment, organic pigment, etc. in a binder (as proposed in, for instance, Japanese Laid-Open Patent Application No. 18543/1972), (3) coating a solution prepared by dissolving a charge generating substance such as organic pigment in an organic amine (as proposed in, for instance, Japanese Laid-Open Patent Application No. 55643/1977), etc. has been prevalent.

In the case of the foregoing process (1), however, though it can afford a uniform and very thin layer, it is defective in that the cost of the equipment is high and the manufacturing process is difficult to control. In the case of process (2), since various technics for dispersing as well as coating have been established, the element can be manufactured easily and profitably from the viewpoint of cost, but for the purpose of obtaining an extremely thin layer steadily, the dispersibility and the dispersion stability of the dispersion per se come into question. In the case of process (3), the element can be manufactured easily for the same reasons as in the case of process (2), but it involves questions in respect of the safety and the stability of the solution per se, and will result in high cost of equipment.

SUMMARY OF THE INVENTION

The primary object of the present invention is to provide an electrophotographic element which comprises a uniform, extremely thin and smooth charge generating layer and is accordingly high in sensitivity and shows low degree of fatigue.

The second object of the present invention is to provide a process for manufacturing an electrophotographic element capable of demonstrating improved dispersibility as well as dispersion stability of a charge generating layer forming liquid in spite of application of the foregoing process (2) by virtue of the combination of a charge generating substance consisting of a specific organic pigment with a mixture of specific binder materials.

In other words, an electrophotographic element according to the present invention is characterized in that a charge generating layer and a charge transport layer are formed, in order, on an electroconductive substrate, said charge generating layer comprising a disazo pigment expressed by the general formula:

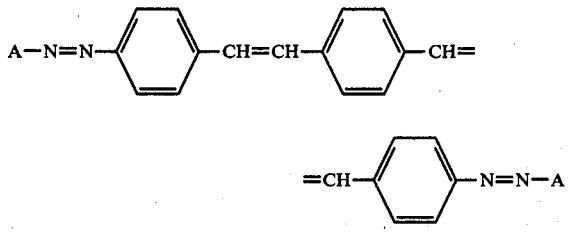

[wherein A represents

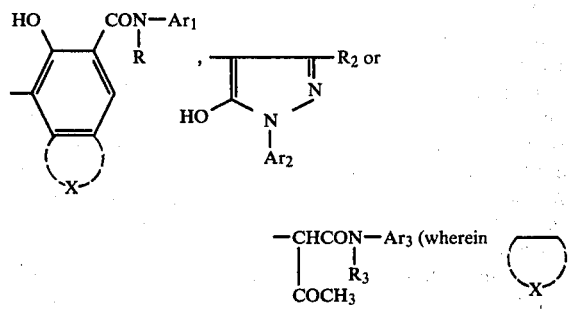

represents a member selected from the group consisting of benzene ring, naphthalene ring, indole ring, carbazole ring, benzofuran ring and their substitutes; $Ar_1$ represents a member selected from the group consisting of benzene ring, naphthalene ring, dibenzofuran ring, carbazole ring and their substitutes; each of $Ar_2$ and $Ar_3$ represents a member selected from the group consisting of benzene ring, naphthalene ring and their substitutes; each of $R_1$ and $R_3$ represents a member selected from the group consisting of hydrogen, lower alkyl radical, phenyl radical and their substitutes; and $R_2$ represents a member selected from the group consisting of lower alkyl radical, carboxyl radical and alkyl ester thereof) ] and a mixture of binder materials comprising polyvinyl butyral and acrylic resin.

The process for manufacturing an electrophotographic element according to the present invention is a process comprising coating a charge generating layer forming liquid and a charge transport layer forming liquid, in order, on an electroconductive substrate, in which said charge generating layer forming liquid is a dispersion obtained by dispersing a disazo pigment expressed by the foregoing general formula in the foregoing mixture of binder materials.

By virtue of coating such a dispersion on an electroconductive substrate, there can be obtained a uniform charge generating layer that is very fine, smooth and flawless. Further, by virtue of employing a disazo pigment expressed by the foregoing general formula together with said mixture of binder materials, there can be obtained a layered electrophotographic element that is high in sensitivity and low in degree of fatigue.

By the way, in the case where a dispersion is prepared by using polyester, polycarbonate, polystyrene, polyvinyl acetate, polyvinyl chloride, polyamide, polyurethane, various celluloses, etc. that are popular in the field of electrophotography as binders for pigment, electron acceptor, electron donor or the like together with some pigment, the resulting dispersion comes to have a poor dispersibility and dispersion stability and gives rise to precipitation. In the case where polyvinyl butyral and acrylic resin, which are not popular as binders for pigments, are independently used, the result is the same as above.

On the contrary, in the case where polyvinyl butyral and acrylic resin are jointly used as proposed in the present invention, there is obtained a pigment dispersion superior in dispersibility and dispersion stability and coating of this dispersion on a substrate has proved to bring about an extremely thin, smooth and flawless charge generating layer in spite of its being a dispersion system. Moreover, this dispersion has an advantage that it can be diluted to a desired density without impairing its excellent dispersibility and dispersion stability.

The reason why such an excellent dispersion is obtainable seems to be, in the final analysis, that the so-called pigment-resin-solvent solubility parameter concerning dispersion system, that is, hydrogen-bond energy, is well balanced in the disazo pigment-polyvinyl butyral-acrylic resin-solvent system for use in the present invention. As a fact to support this analysis, it can be pointed out that, when a dispersion according to the present invention is examined through an electron microscope, each particle of the pigment is extremely fine (average particle diameter: about 0.1 micron) and uniform, and is free from coagulation. On the other hand, in the case of a pigment dispersion obtained by employing polyvinyl butyral or acrylic resin alone, or employing any other binder, even when a disazo pigment expressed by the foregoing general formula is employed, there is observed coagulation of large pigment particles having an average diameter of 1 micron to 5 microns or thereabouts, and the pigment and resin are in the state of being separated. As regards the resulting coating film, in the case of a dispersion of the present invention, it is uniform and glossy, and when the surface and the section thereof are examined through an electron microscope, the pigment forms a uniform and close layer within the resin, whereas in the case of a dispersion obtained by employing polyvinyl butyral or acrylic resin alone or employing any other binder, even when a disazo pigment expressed by the foregoing general formula is employed, the surface of the resulting coating film is rough and glossless, and when examined through an electron microscope in the same way as above, a lot of coagulation of pigment particles and flaws in the coating are observed on the surface and numerous jogs in the section.

In view of these facts, the improvement of the dispersibility and dispersion stability of a dispersion of the present invention is considered attributable to the formation of a diffusion double layer resulting from adsorption of polyvinyl butyral to masses of pigment particles and further adsorption of acrylic resin to the thus adsorbed polyvinyl butyral.

Disazo pigments expressed by the foregoing general formula for use in the present invention can be obtained through, for instance, the process disclosed in Japanese Laid-Open Patent Application No. 48859/1977 (U.S. Ser. No. 898130 now U.S. Pat. No. 4,272,598). In this connection, to give a concrete example of the substituent attached to

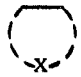

in the general formula, there is halogen; to give concrete examples of the substituent attached to $Ar_3$ therein, there are halogen, alkyl radical having 1 to 4 carbon atoms, alkoxyl radical having 1 to 4 carbon atoms, dialkylamino radical in which each alkyl has 1 to 4 carbon atoms, cyano radical, carboxyl radical, nitro radical and sulfo radical; and to give concrete examples of the substituent attached to $Ar_2$ or $Ar_3$ therein, there are nitro radical, sulfoamino radical, sulfo radical, halogen, alkyl radical having 1 to 4 carbon atoms, alkoxyl radical having 1 to 4 carbon atoms, cyano radical, dialkylamino radical in which each alkyl has 1 to 4 carbon atoms, and acylamino radical in which each alkyl has 1 to 4 carbon atoms. As the lower alkyl radical represented by each of $R_1$, $R_2$ and $R_3$ in the formula, ones having 1 to 4 carbon atoms are appropriate. As the substituent of phenyl radical represented by each of $R_1$ and $R_3$ in the formula, there can be cited halogen. Further, as the alkyl radical of carboxylic alkyl ester represented by $R_2$ in the formula, ones having 1 to 4 carbon atoms are appropriate.

As concrete examples of disazo pigment expressed by the foregoing general formula, there can be cited the following compounds:

Compound No.

1.

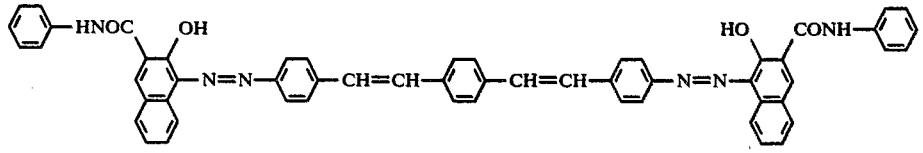

2.

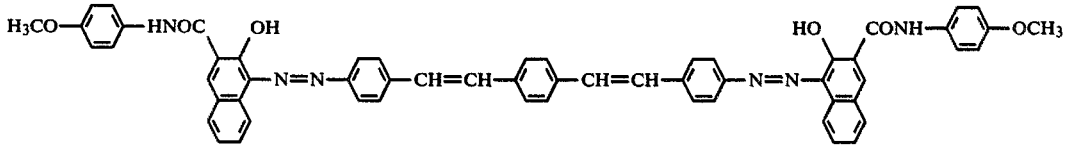

-continued
3. 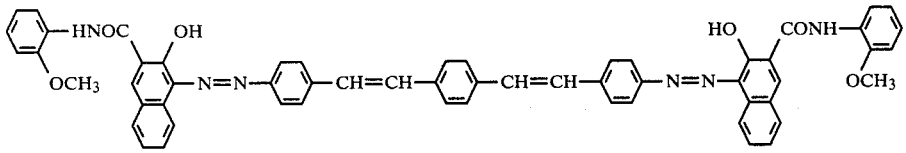
4. 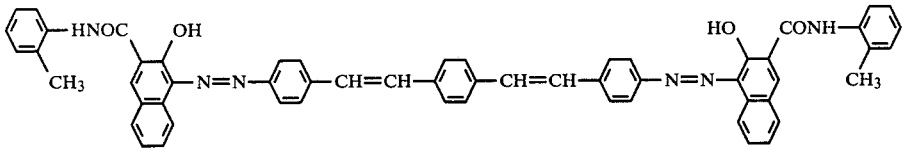
5. 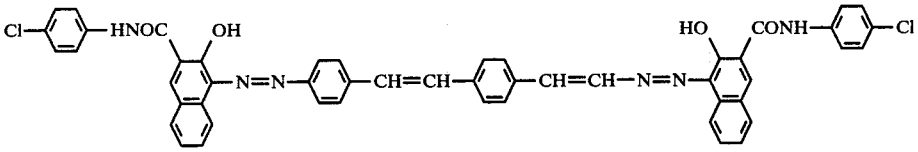
6. 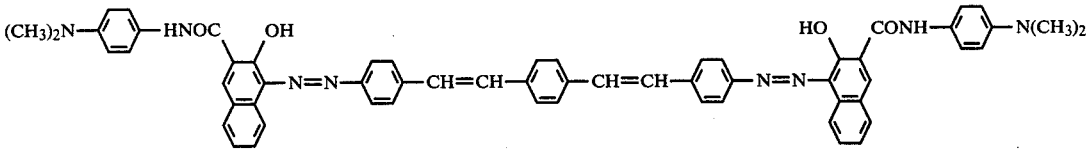
7. 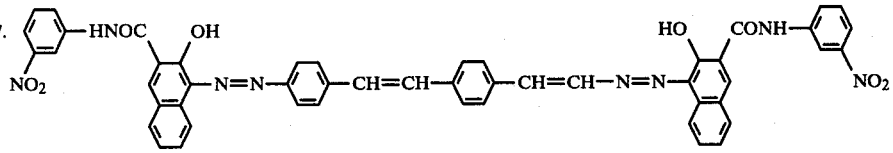
8. 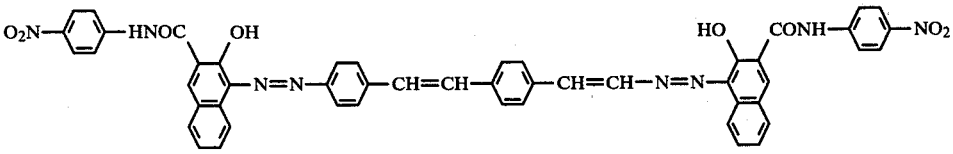
9. 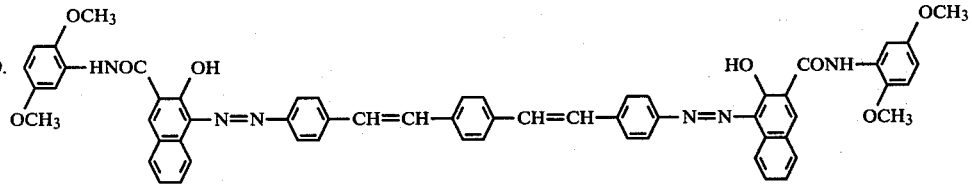
10. 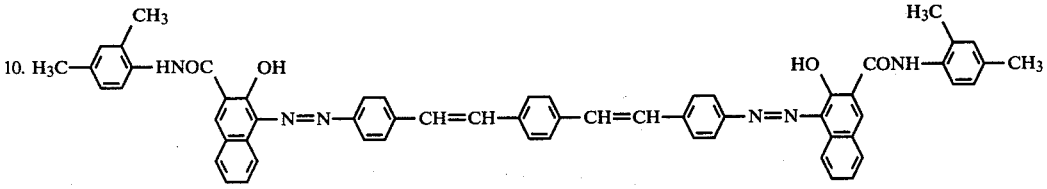
11. 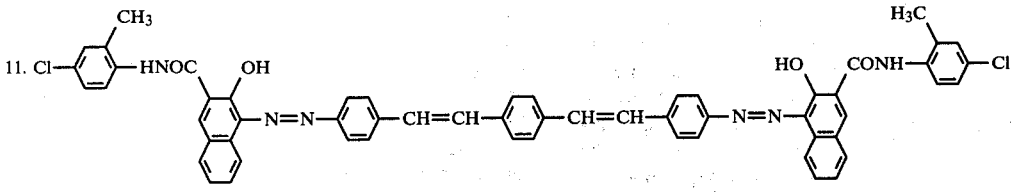

-continued

12. 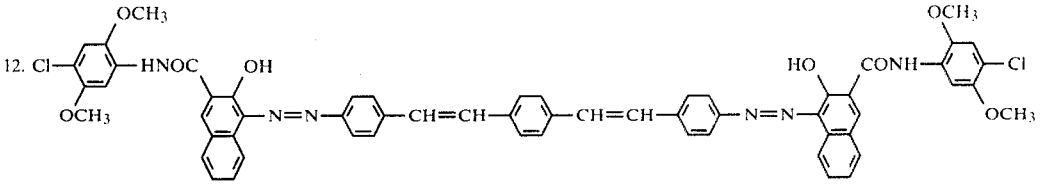

13. 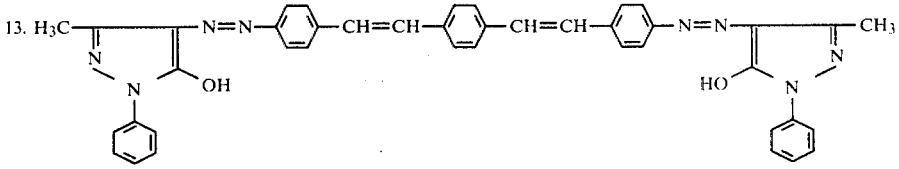

14. 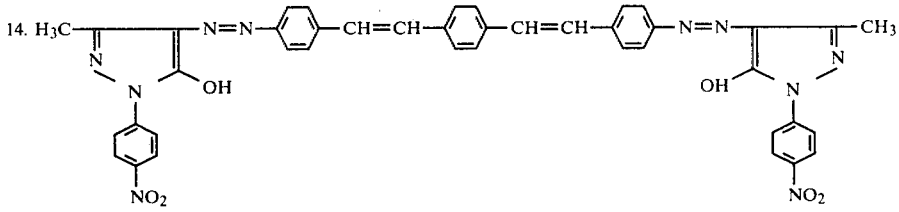

As to the polyvinyl butyral for use in the present invention, it suffices to be of the ordinary grade useful for paints, yet it is desirable that butyralization degree thereof be 60 mol.% or more and the average polymerization degree thereof be in the range of from 250 to 2000. To cite commercial articles applicable, there are DENKA BUTYRAL (the manufacture of TOKYO DENKI KAGAKU KOGYO K.K.), S-lec B (the manufacture of SEKISUI KAGAKU KOGYO K.K.), XYHL and XYSG (the manufactures of Union Carbide Co.), etc.

As to the acrylic resin for use in the present invention, it suffices to be an optional one of well-known appropriate acrylic polymers or copolymers or the like useful for electrophotographic elements. To give concrete examples of such acrylic resins, there are polymers of acrylic acid and methacrylic acid like polyacrylic acid, polymethacrylic acid, poly(methyl methacrylate), poly(n-butyl methacrylate), poly(isobutyl methacrylate), etc. and ester of these acids. To cite commercial articles applicable, there are BR-50, BR-60, BR-75, BR-80, BR-83, BR-85, BR-88, BR-90, BR-95, BR-96, BR-101, BR-102, BR-105 and BR-107 (the foregoing are manufactures of MITSUBISHI RAYON K.K.), Elvacite 2008, 2009, 2010, 2013, 2041, 2042, 2043, 2044, 2045 and 2046 (the foregoing are manufactures of Du Pont Inc.), ACRYLOID A-10, A101, A-11, A-21, B-66 and B-67 (the foregoing are manufactures of ROHM & HASS Inc.), etc.

In the present invention, the aforedescribed materials are dispersed in an appropriate solvent and the resulting dispersion is coated on a plastic film, paper or metallic plate such as aluminum plate and dried thereafter, whereby a charge generating layer is formed. To cite applicable solvents, there are benzene, toluene, xylene, monochlorobenzene, dichlorobenzene, ethyl acetate, dioxane, tetrahydrofuran, dimethylformamide, methyl cellosolve, ethyl cellosolve, methyl ethyl ketone and their mixtures. The appropriate thickness of the resulting charge generating layer is in the range of from 0.04 micron to 20 microns, preferably in the range of from 0.05 micron to 2 microns or thereabouts. The appropriate amount of a binder to be employed is in the range of from 10% to 200% by weight, preferably in the range of from 20% to 100% by weight, relative to disazo pigment employed, but the weight ratio of polyvinyl butyral to acrylic resin must be in the range of from 0.1:1 to 1:0.1. In this connection, when this weight ratio is less than 0.1:1, the dispersion stability of the resulting dispersion would deteriorate, while when it is more than 1:0.1, the pigment particles would be apt to agglomerate, thereby rendering it difficult to form a uniform and smooth charge generating layer stably.

Meanwhile, the material for forming the charge transport layer suffices to be one useful for conventional laminate-type electrophotographic elements. In other words, as the material for this purpose, there can be cited such electron donors as poly-N-vinyl carbazole and its derivatives, poly-γ-carbazolyl ethyl glutamate and its derivatives, pyrene-formaldehyde condensate and its derivatives, polyvinyl pyrene, polyvinyl phenanthrene, oxazole derivatives, oxadiazole derivatives, imidazole derivatives, 9-(p-diethylaminostyryl)anthracene, 1,1-bis(4-dibenzylaminophenyl)propane, styryl anthracene, styryl pyrazoline, phenyl hydrazones, etc. and such electron acceptors as fluorenone derivatives, dibenzothiophene derivatives, indenothiophene derivatives, phenanthrene quinone derivatives, indenopyridine derivatives, thioxanthone derivatives, benzo[c]cinnoline derivatives, phenazine oxide derivatives, tetracyanoethylene, tetracyanoquinodimethane, bromanil, chloranil, benzoquinone, etc. These materials are usually employed jointly with some binder and, if necessary, some sensitizer and/or plasticizer are further added thereto, and the resulting mixture is coated on a charge generating layer after dissolving in an appropriate solvent. The appropriate thickness of the charge transport layer to be thus prepared is in the range of from 5 microns to 100 microns or thereabouts, preferably in the range of from 7 microns to 25 microns. As the binder to be employed, any of the conventional binders such as described above is applicable as it is. The appropriate weight ratio of the donor or the acceptor to the binder is in the range of from 1:10 to 1:0.3 or thereabouts.

Further, in the present invention, for the purpose of improving the interlayer adhesiveness as well as the electrification characteristics of the resulting element, an adhesive layer of polyamide, polyvinyl acetate, polyurethane or the like or a thin layer of aluminum oxide or the like having a thickness in the range of from 0.01 micron to 1.0 micron or thereabouts can be provided on the electroconductive substrate by a conventional method, such as coating process, process of depositing through vacuum evaporation, etc., prior to forming the charge generating layer.

DESCRIPTION OF THE PREFERRED EMBODIMENTS

In the following will be given examples embodying the present invention:

EXAMPLE 1

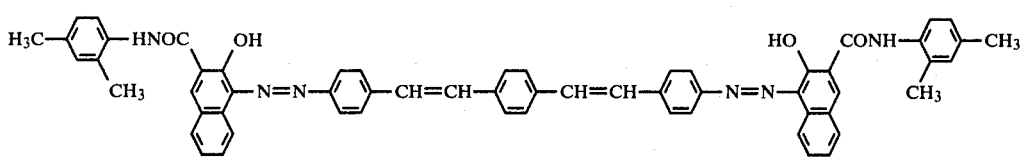

| | |
|---|---|
| | 1 g |
| 5 wt. % tetrahydrofuran solution of polyvinyl butyral (namely, DENKA BUTYRAL #4000-1, the manufacture of TOKYO DENKI KAGAKU K.K.) | 3 g |
| 5 wt. % tetrahydrofuran solution of poly(methyl methacrylate) (namely, DIANAL BR-80, the manufacture of MITSUBISHI RAYON K.K.) | 7 g |
| tetrahydrofuran | 9 g |

A mixture of the foregoing composition was crushed within a ball mill and thereafter a mixture solvent comprising ethyl cellosolve and tetrahydrofuran at a weight ratio of 2:8 was added dropwise while stirring, whereby a pigment dispersion with a solid content of 1% by weight was prepared. Next, this dispersion was coated by means of a doctor blade on a 75-micron thick polyester film deposited with aluminum through vacuum evaporation and was dried thereafter, whereby a 0.5-micron thick charge generating layer was formed. Further, a solution having the following composition was coated on this layer and was dried to form a 15-micron thick charge transport layer, whereby there was obtained a layered electrophotographic element.

| | |
|---|---|
| 9-(p-diethylaminostyryl)anthracene | 1 g |
| polycarbonate (namely, PANLITE K-1300, the manufacture of TEIJIN K.K.) | 1 g |
| tetrahydrofuran | 8 g |

EXAMPLE 2

By applying the same process as that in Example 1 except for replacing the 5 wt.% tetrahydrofuran solution of poly(methyl methacrylate) used in the charge generating layer forming dispersion with a 5 wt.% tetrahydrofuran solution of poly(n-butyl methacrylate) (namely, DIANAL BR-102, the manufacture of MITSUBISHI RAYON K.K.), a layered electrophotographic element was prepared.

EXAMPLE 3

By applying the same process as that in Example 1 except for replacing the 5 wt.% tetrahydrofuran solution of poly(methyl methacrylate) used in the charge generating layer forming dispersion with a 5 wt.% tetrahydrofuran solution of methyl methacrylate-methyl acrylate copolymer (namely, DIANAL BR-75, the manufacture of MITSUBISHI RAYON K.K.), a layered electrophotographic element was prepared.

Comparative Example 1

By applying the same process as that in Example 1 except for replacing 3 g of the 5 wt.% tetrahydrofuran solution of polyvinyl butyral and 7 g of the 5 wt.% tetrahydrofuran solution of poly(methyl methacrylate) used in the charge generating layer forming dispersion with 10 g of a 5 wt.% tetrahydrofuran solution of polyvinyl butyral (the same as that in Example 1), a layered electrophotographic element was prepared.

Comparative Example 2

By applying the same process as that in Example 1 except for replacing 3 g of the 5 wt.% tetrahydrofuran solution of polyvinyl butyral and 7 g of the 5 wt.% tetrahydrofuran solution of poly(methyl methacrylate) used in the charge generating layer forming dispersion with 10 g of a 5 wt.% tetrahydrofuran solution of poly(methyl methacrylate) (the same as that in Example 1), a layered electrophotographic element was prepared.

Comparative Example 3

By applying the same process as that in Example 1 except for replacing 3 g of the 5 wt.% tetrahydrofuran solution of polyvinyl butyral and 7 g of the 5 wt.% tetrahydrofuran solution of poly(methyl methacrylate) used in the charge generating layer forming dispersion with 10 g of a 5 wt.% tetrahydrofuran solution of polyester (namely, BYRON 200, the manufacture of TOYO BOSEKI K.K.), a layered electrophotographic element was prepared.

Next, each of the pigment dispersions prepared in Examples 1 through 3 and Comparative Examples 1 through 3 was examined with respect to its dispersion stability by putting it in a precipitation tube. Besides, each electrophotographic element prepared in these examples was charged by means of a corona discharge of −6 KV for 20 seconds in a commercial testing apparatus for electrostatic copying paper, and its surface potential Vs(volt) at that time was measured. Further, after standing it in the dark for 20 seconds subsequent thereto, its surface potential Vo(volt) at that time was measured. Subsequently, each element was exposed to the light of a white tungsten lamp of 20 luxes, and thereafter the amount of exposure E1/10 (in terms of lux.-sec.) required for decay of Vo to one tenth (1/10) and the surface potential Vo30 after 30 seconds' exposure-to-light were measured. Moreover, this process of charging (for 20 seconds)→dark decay (20 seconds after)→exposure to light (for 30 seconds) was repeated 10 times and the change in the value of characteristics of each element was examined. The results were as shown in the following table.

| | Precipitation during 1st day | Precipitation by the end of 7th day | | Vs | Vo | E1/10 | Vo30 |
|---|---|---|---|---|---|---|---|
| | | | 1st time | 1320 | 1150 | 4.8 | 0 |
| Example 1 | 0 cm | 0 cm | | | | | |
| | | | 10th time | 1300 | 1135 | 4.8 | 0 |
| | | | 1st time | 1280 | 1110 | 5.0 | 0 |
| Example 2 | 0 cm | 0 cm | | | | | |
| | | | 10th time | 1250 | 1080 | 5.1 | 0 |
| | | | 1st time | 1300 | 1120 | 4.9 | 0 |
| Example 3 | 0 cm | 0 cm | | | | | |
| | | | 10th time | 1280 | 1105 | 5.0 | 0 |
| Comparative | | | 1st time | 1340 | 1140 | 4.9 | 5.0 |
| Example 1 | 0.8 cm | 3.2 cm | | | | | |
| | | | 10th time | 1010 | 820 | 5.3 | 20.0 |
| Comparative | | | 1st time | 1390 | 1180 | 4.8 | 7.0 |
| Example 2 | 1.5 cm | 5.7 cm | | | | | |
| | | | 10th time | 980 | 730 | 5.4 | 35.0 |
| Comparative | | | 1st time | 1290 | 1080 | 5.0 | 15.0 |
| Example 3 | 1.2 cm | 4.5 cm | | | | | |
| | | | 10th time | 870 | 640 | 6.2 | 48.0 |

What is claimed is:

1. An electrophotographic element comprising an electroconductive substrate, a charge generating layer and a charge transport layer, said charge generating layer comprising a disazo pigment having the general formula:

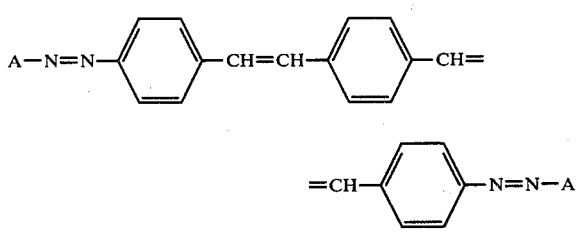

wherein A is a member selected from the group consisting of

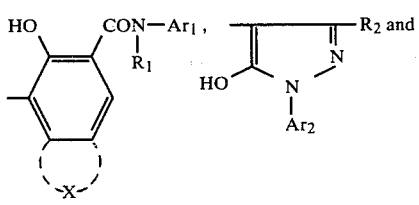

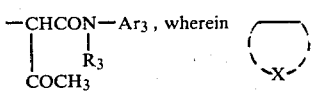

is a fused ring selected from the group consisting of benzene ring, halobenzene ring, naphthalene ring, indole ring, carbazole ring and benzofuran ring; $Ar_1$ is a member selected from the group consisting of phenyl, methylphenyl, methoxyphenyl, chlorophenyl, nitrophenyl, ethoxyphenyl, methylchlorophenyl, dimethylphenyl, methoxychlorophenyl, methoxybromophenyl, methoxymethylphenyl, dimethoxyphenyl, dimethoxychlorophenyl, dimethylaminophenyl, cyanophenyl, carboxyphenyl, benzenesulfonic acid sodium salt, tert-butoxyphenyl, naphthyl, methoxydibenzofuryl and carbazolyl; each of $Ar_2$ and $Ar_3$ is a member selected from the group consisting of phenyl, naphthyl, methoxyphenyl, methylphenyl, acetylaminophenyl, dimethylaminophenyl, cyanophenyl, nitrophenyl, dinitrophenyl, chlorophenyl, trichlorobenzenesulfonic acid, benzenesulfonic acid and benzenesulfonamide; each of $R_1$ and $R_3$ is a member selected from the group consisting of hydrogen, methyl, ethyl, phenyl and chlorophenyl; and $R_2$ is a member selected from the group consisting of methyl, carboxyl and $—COOC_2H_5$, and a binder material consisting essentially of a mixture of polyvinyl butyral and acrylic resin, wherein the weight ratio of polyvinyl butyral to acrylic resin in said mixture is in the range of from 0.1:1 to 1:0.1, the amount of said mixture is 10 to 200% by weight, based on the weight of said disazo pigment, the thickness of said charge generating layer is in the range of from about 0.05 micron to about 2 microns and the thickness of said charge transport layer is in the range of about 5 microns to about 100 microns.

2. An electrophotographic element according to claim 1, wherein the amount of said mixture is 20 to 100% by weight, based on the weight of said disazo pigment.

3. An electrophotographic element according to claim 1, wherein the thickness of said charge transport layer is in the range of from about 7 microns to about 25 microns.

4. An electrophotographic element according to claim 1, wherein said disazo pigment is a compound expressed by the following formula:

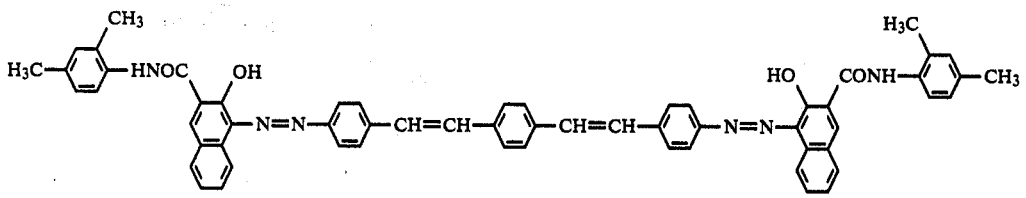
5. An electrophotographic element according to claim 1, wherein said disazo pigment is a member selected from the group of compounds expressed by the following formulas respectively:
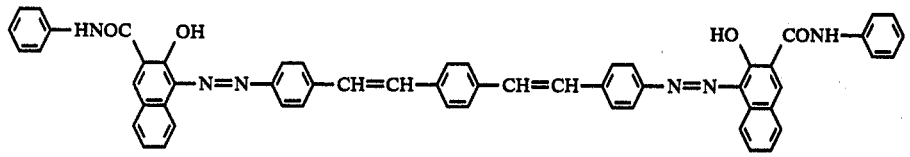
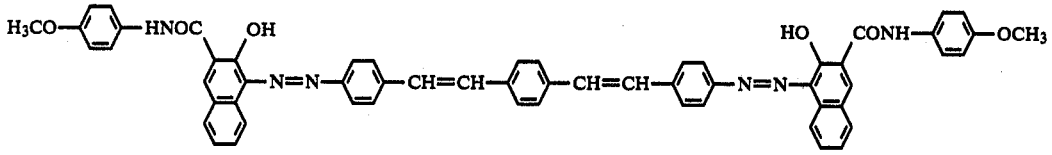
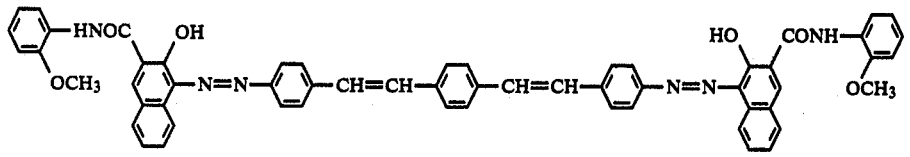
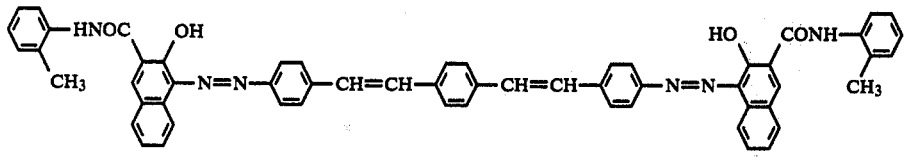
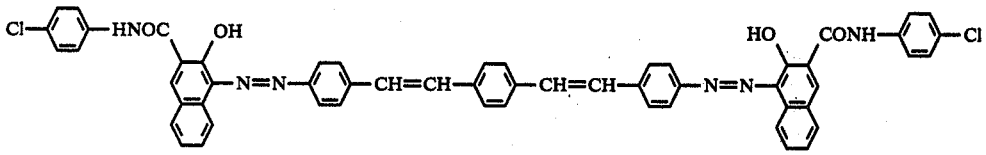
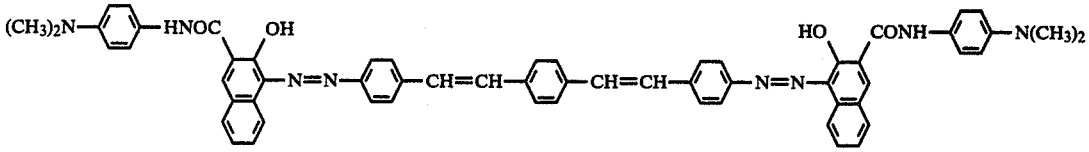
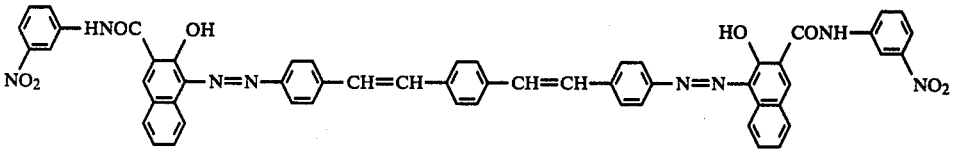

-continued
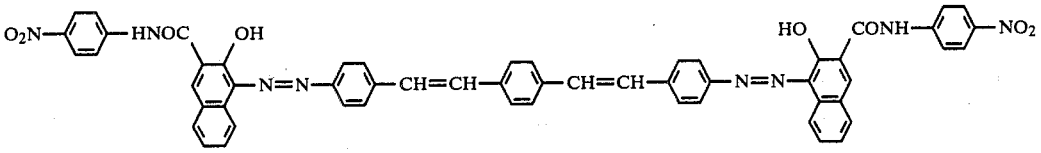
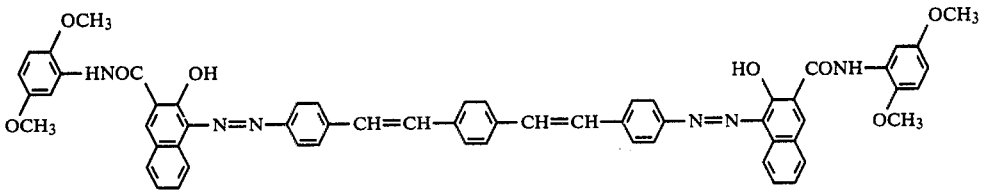
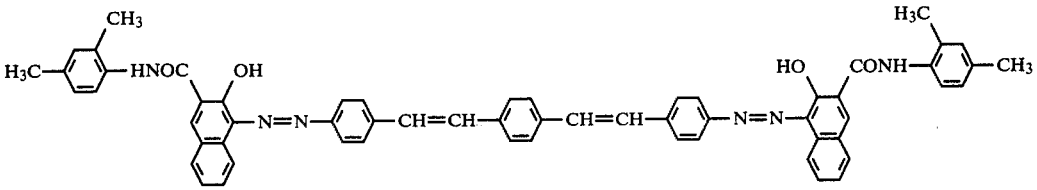
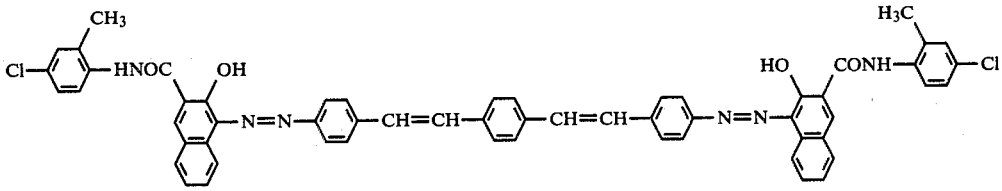
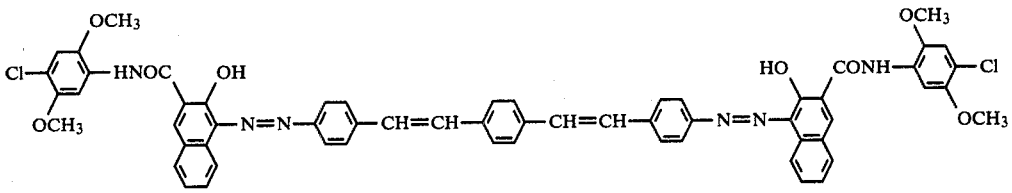
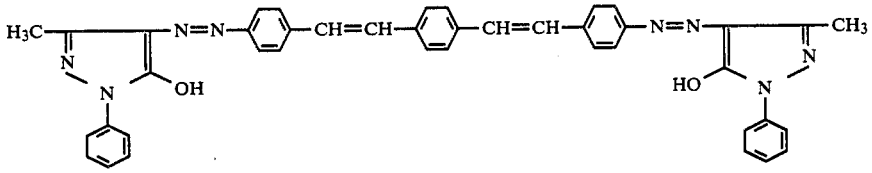
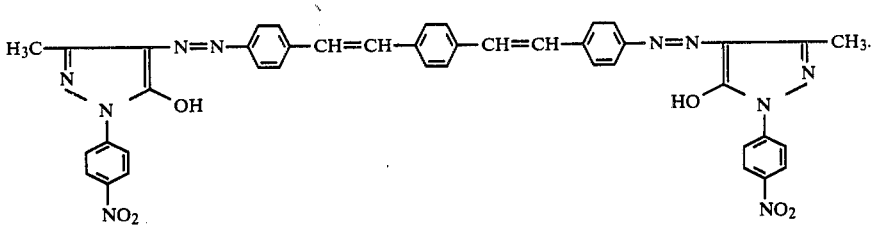
* * * * *